United States Patent [19]

Tazaki et al.

[11] Patent Number: 4,846,938

[45] Date of Patent: Jul. 11, 1989

[54] METHOD OF MANUFACTURING A POROUS ELECTROFORMED OBJECT

[75] Inventors: Yuichi Tazaki; Osamu Ishigami; Akira Ichikawa; Daijyu Yoshino; Akira Soyama, all of Sayama, Japan

[73] Assignee: Honda Giken Kogyo Kabushiki Kaisha, Tokyo, Japan

[21] Appl. No.: 218,247

[22] Filed: Jul. 13, 1988

[30] Foreign Application Priority Data

Jul. 13, 1987 [JP] Japan ..... 62-175415
Jun. 7, 1988 [JP] Japan ..... 63-141270

[51] Int. Cl.[4] ..... C25D 1/08
[52] U.S. Cl. ..... 204/11
[58] Field of Search ..... 204/3, 4, 11

[56] References Cited

U.S. PATENT DOCUMENTS 2,858,256 10/1958 Fahnoe ..... 204/4

*Primary Examiner*—T. M. Tufariello
*Attorney, Agent, or Firm*—Birch, Stewart, Kolasch & Birch

[57] ABSTRACT

An electrically conductive layer is formed on a surface of a model, and an organic solvent layer of an organic solvent which is inactive with respect to the conductive layer is formed on a surface of the conductive layer. Particles are then placed on the organic solvent layer to allow the particles to be partly melted by the organic solvent layer, and the organic solvent layer is removed to allow the particles to be adhered to the conductive layer. A metal layer is deposited on the model in an electroforming process to form an electroformed shell thinner than the diameter of the particles. The electroformed shell is separated from the model, and the particles are dissolved away from the electroformed shell with an organic solvent to produce an electroformed object having a number of vent apertures.

20 Claims, 8 Drawing Sheets

METHOD OF MANUFACTURING A POROUS ELECTROFORMED OBJECT

BACKGROUND OF THE INVENTION

The present invention relates to a method of manufacturing a porous electroformed object, and more particularly to a method of manufacturing a porous electroformed object which will be used to form a covering layer that serves as an interior component of an automobile, for example, according to a vacuum forming process, by coating an organic solvent on an electrically conductive layer on a pattern model, adhering particles that can be dissolved by the organic solvent to the electrically conductive layer, depositing a metal layer on the electrically conductive layer in an electroforming process, and then dissolving away the particles for thereby producing an electroformed object which has a desired number of vent apertures of desired diameters that can easily be selected at desired locations.

Console boxes and other interior components of automobiles have covering layers with their outer surfaces having certain designed surface irregularities. The covering layers of these automobile interior components are usually in the form of sheets of synthetic resin such as polyvinyl chloride which are formed by the vacuum forming process using a porous electroformed mold having a plurality of vent apertures.

Porous electroformed objects for use as molds in the vacuum forming process have heretofore been manufactured according to various methods. In one method, an electrically conductive layer is formed on the surface of a model having a desired covering pattern, then an electroformed shell is produced of metal deposited on the conductive layer by an electroforming process, and thereafter the electroformed shell is separated from the conductive layer and drilled or processed by laser machining to produce a porous electroformed object.

The laser machining process requries a considerably expensive piece of equipment, and is time-consuming in the formation of a multiplicity of vent holes or apertures. Therefore, the laser machining process is poor in productivity. The drilling process is disadvantageous in that vent apertures of a diameter smaller than the diameter of the drill cannot be formed, and that many processing steps are required to form a number of vent apertures as with the laser machining process.

Japanese Laid-Open Patent Publication No. 60-152696 discloses a method of manufacturing a porous electroformed object by forming on the surface of a model a sprayed layer comprising an electrically conductive coated film mixed with an insulating material such as a lacquer solution of vinyl chloride, and electrolyzing the model in an electrolytic solution. According to this method, however, vent apertures cannot selectively be defined in the electroformed object at desired locations. Therefore, if the electroformed object has a complex shape, it is difficult to bring a synthetic resin sheet into intimate contact with the electroformed object in the vacuum forming process, with the result that a defective product may be fabricated. Another problem is that an electrolytic solution has to be prepared solely for use in this method.

Another known method disclosed in Japanese Laid-Open Patent Publication No. 61-253392 produces a porous electroformed object by forming a silver layer on the surface of a model through the silver mirror reaction, coating a silver etchant on an area of the silver layer where vent apertures are to be defined, and depositing a metal layer in the electroforming process. This disclosed method however requires an area of the silver layer where no vent apertures are needed, to be sealed, and should include a procedure for coating the silver etchant on the area where the vent apertures should be defined. As a result, the entire process of producing a porous electroformed object is complex, and the porous electroformed object cannot be fabricated efficiently. Since the silver etchant is employed, any particular locations where vent apertures are to be formed cannot specifically be identified, and it is impossible to select the diameter of such vent apertures as desired.

The applicant has proposed a method of manufacturing a porous electroformed object by first forming an electrically conductive layer on the surface of a model, putting a layer of particles on the surface of the conductive layer, depositing a metal layer through the electroforming process to produce an electroformed shell, and then dissolving away the particles to form a plurality of vent apertures in the electroformed shell (see U.S. Patent Ser. No. 813,252). The proposed method is advantageous in that an electroformed object having many minute vent holes can easily and efficiently be produced through quite a simple process.

SUMMARY OF THE INVENTION

It is an object of the present invention to provide a method of manufacturing a porous electroformed object by forming an electrically conductive layer on the surface of a model through silver plating, depositing an organic solvent layer which is inactive with respect to silver on the conductive layer, selectively adhering particles which are dissolvable by the organic solvent, then removing the organic solvent, thereafter depositing a metal layer on the model to form an electroformed shell, and dissolving away the particles from the electroformed shell with an organic solvent, so that a desired number of vent apertures or holes cn be formed at desired locations, and the diameter of vent apertures can be adjusted by adhering the particles to the conductive layer, with the result that the porous electroformed object thus produced is of sufficient mechanical strength and a covering layer of excellent quality can be produced by the porous electroformed object according to the vacuum forming process.

Another object of the present invention is to provide a method of manufacturing a porous electroformed object, comprising the steps of: forming an electrically conductive layer on a surface of a model; forming an organic solvent layer of an organic solvent which is inactive with respect to said conductive layer on a surface of said conductive layer; placing particles on said organic solvent layer to allow the particles to be partly melted by the organic solvent layer; removing said organic solvent layer to allow the particles to be adhered to said conductive layer; depositing a metal layer on said model in an electroforming process to form an electroformed shell thinner than the diameter of said particles; separating said electroformed shell from said model; and dissolving said particles away from said electroformed shell with an organic solvent to produce an electroformed object having a number of vent apertures.

Still another object of the present invention is to provide a method of manufacturing a porous electroformed object, wherein the diameter of said particles to be adhered to said conductive layer and the thickness of said organic solvent layer are selected to adjust the manner in which said particles are adhered to said conductive layer by said organic solvent.

Yet another object of the present invention is to provide a method of manufacturing a porous electroformed object, wherein said conductive layer comprises one of a silver plated layer, a nickel plated layer, and a copper plated layer.

Yet still another object of the present invention is to provide a method of manufacturing a porous electroformed object, wherein each of said particles has a plurality of radially outward projections.

A further object of the present invention is to provide a method of manufacturing a porous electroformed object, wherein said organic solvent comprises a mixture solution containing ethanol and at least one material selected from the group consisting of methyl ethyl ketone, ethylene dichloride, toluene, ethylene tetrachloride, xylene, and methylene chloride.

A further object of the present invention is to provide a method of manufacturing a porous electroformed object, wherein said organic solvent comprises at least one material selected from the group consisting of methyl ethyl ketone, ethylene dichloride, toluene, ethylene tetrachloride, xylene, and methylene chloride.

A still further object of the present invention is to provide a method of manufacturing a porous electroformed object, wherein each of said particles is made of a material selected from the group consisting of polystyrene, acrylic resin, and polyvinyl chloride.

A yet further object of the present invention is to provide a method of manufacturing a porous electroformed object, wherein after a first electroformed shell has been formed on the conductive layer on the surface of said model, second particles are adhered to first particles exposed out of said first electroformed shell by an organic solvent, then a metal layer is deposited on said model to form a second electroformed shell integrally on said first electroformed shell, said second electroformed shell being thinner than the diameter of said second particles, and said first and second electroformed shells are separated from said model, after which said first and second particles are dissolved away by an organic solvent to produce an electroformed object having a number of vent apetures.

A yet still further object of the present invention is to provide a method of manufacturing a porous electroformed object, comprising the steps of: forming an electrically conductive layer on a surface of a model; forming an organic solvent layer of an organic solvent which is inactive with respect to said conductive layer on a surface of said conductive layer; selecting the type and/or diameter of particles to be adhered to said conductive layer dependent on said organic solvent to adjust the manner in which the particles are to be adhered to said conductive layer; placing said particles on said organic solvent layer to allow the particles to be partly melted by the organic solvent layer; removing said organic solvent layer to allow the particles to be adhered to said conductive layer; depositing a metal layer on said model in an electroforming process to form an electroformed shell thinner than the diameter of said particles; separating said electroformed shell from said model; and dissolving said particles away from said electroformed shell with an organic solvent to produce an electroformed object having a number of vent apertures.

Yet another object of the present invention is to provide a method of manufacturing a porous electroformed object, wherein the type of said particles to be adhered to said conductive layer is selected dependent on the type of said organic solvent.

Yet still another object of the present invention is to provide a method of manufacturing a porous electroformed object, wherein the type of said particles to be adhered to said conductive layer is selected dependent on the concentration of said organic solvent.

A further object of the present invention is to provide a method of manufacturing a porous electroformed object, wherein the diameter of said particles to be adhered to said conductive layer is selected dependent on the type of said organic solvent.

A still further object of the present invention is to provide a method of manufacturing a porous electroformed object, wherein the diameter of said particles to be adhered to said conductive layer is selected dependent on the concentration of said organic solvent.

A yet further object of the present invention is to provide a method of manufacturing a porous electroformed object, wherein said organic solvent comprises a mixture solution of xylene and ethanol.

Another object of the present invention is to provide a method of manufacturing a porous electroformed object, wherein each of said particles is made of a material selected from the group consisting of polystyrene and polyvinyl chloride.

Still yet another object of the present invention is to provide a method of manufacturing a porous electroformed object, comprising the steps of: forming an electrically conductive layer on a surface of a model; forming an organic solvent layer of an organic solvent which is inactive with respect to said conductive layer on a surface of said conductive layer; adjusting the manner in which selected particles are to be adhered to said conductive layer by employing the organic solvent which has been adjusted in its ability to melt the particles dependent on said selected particles; placing said particles on said organic solvent layer to allow the particles to be partly melted by the organic solvent layer; removing said organic solvent layer to allow the particles to be adhered to said conductive layer; depositing a metal layer on said model in an electroforming process to form an electroformed shell thinner than the diameter of said particles; separating said electroformed shell from said model; and dissolving said particles away from said electroformed shell with an organic solvent to produce an electroformed object having a number of vent apertures.

A further object of the present invention is to provide a method of manufacturing a porous electroformed object, wherein said solvent comprises a mixture solution including ethanol.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 7(*b*) is an enlarged fragmentary cross-sectional view showing the manner in which an electroformed shell is produced using particles shown in FIG. 7(*a*);

FIG. 8(*b*) is an enlarged fragmentary cross-sectional view showing the manner in which an electroformed shell is produced using particles shown in FIG. 8(*a*).

DETAILED DESCRIPTION OF THE PREFERRED EMBODIMENTS

Figure 1:
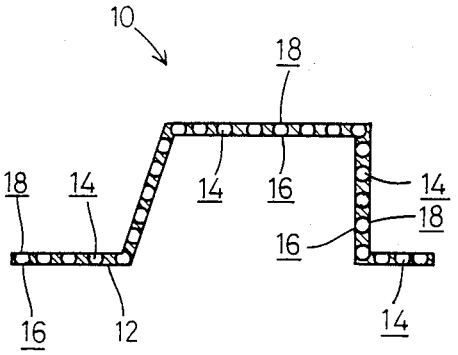
FIG. 1 is a vertical cross-sectional view of an electroformed object manufactured by a method of the present invention.

FIG. 1 schematically shows a porous electroformed object 10 manufactured by a method according to the present invention. The electroformed object 10 is in the form of a thin sheet of a prescribed configuration having a covering surface 12 having a pattern of surface irregularities. The electroformed object 10 has a plurality of vent holes or apertures 14 communicating with openings 16 which open to the exterior at the covering surface 12 and also with openings 18 which open to the exterior at the reverse surface which is opposite to the covering surface 12.

A model 20 used in the method of manufacturing the electroformed object 10 is shown in FIGS. 2(*a*) through 2(*d*). The model 20 has an upper surface 22 complementary to the shape of a desired covering layer and bearing a designed pattern for the covering layer.

FIG. 2(*d*) shows an electroforming tank or container 24 filled with an electrolytic solution 26 in which the model 20 is immersed. Electrodes 32*a*, 32*b*, 32*c* electrically connected to the positive terminal of a power supply 28 through leads 30*a*, 30*b*, 30*c* are disposed near the upper surface 22 of the model 20. An electrically conductive layer which will be formed on the model 20 as described later on is electrically connected to the negative terminal of the power supply 28 through a lead 34.

The method of manufacturing a porous electroformed object according to the present invention is carried out by the arrangement shown in FIGS. 2(*a*) through 2(*d*) as follows:

The method of the present invention employs particles of polystyrene or acrylic resin. Where polystyrene particles are used, methyl ethyl ketone, ethylene dichloride, toluene, ethylene tetrachloride, or xylene is employed as an organic solvent which can dissolve the particles, is inactive with respect to an electrically conductive layer (i.e., a silver plated layer), and is volatile. Where acrylic particles are employed, methylene chloride or ethylene dichloride is preferably used as such an organic solvent. Particles of polyvinyl chloride (PVC) may also be employed.

The upper surface 22 of the model 20 is plated with silver to form an electrically conductive thin silver layer 36 on the upper surface 22, as shown in FIG. 2(*a*).

Figure 3:
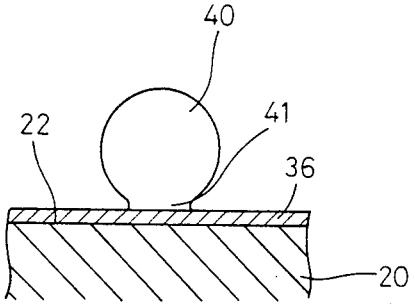
FIG. 3 is an enlarged fragmentary cross-sectional view of a particle adhered to an electrically conductive layer in the method of the present invention.
Figure 2A:
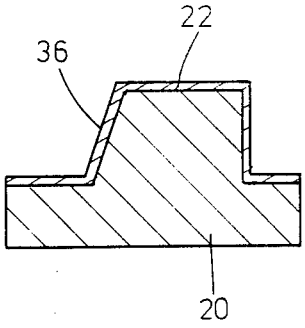
FIGS. 2(*a*) through 2(*d*) are vertical cross-sectional views showing a sequence of steps of the method of the present invention.
Figure 2B:
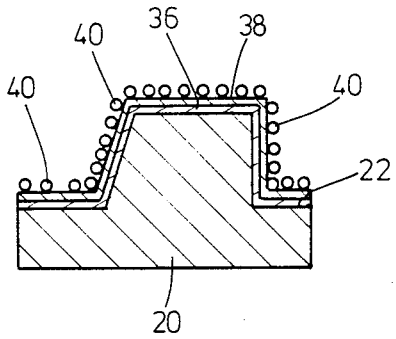
Figure 2C:
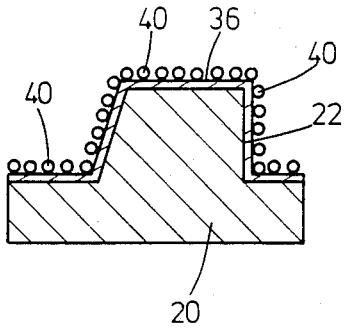
Figure 2D:
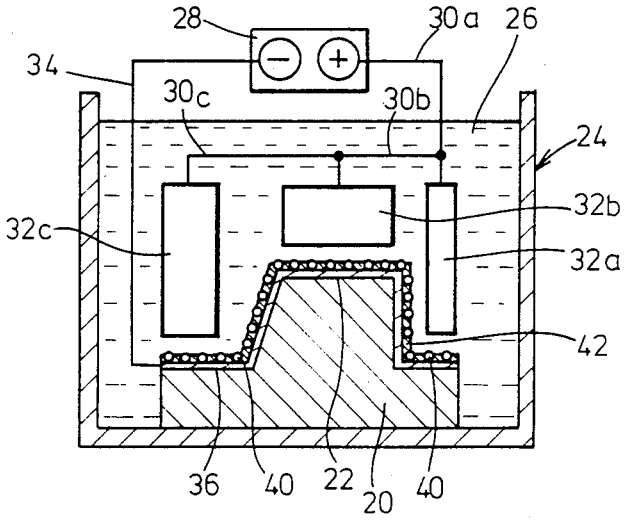

Then, as shown in FIG. 2(*b*)), an organic solvent is coated on the surface of the conductive layer 36 to form a solvent layer 38 having a certain thickness, and a plurality of particles 40 of polystyrene, for example, are placed on the solvent layer 38 at desired positions. The portions of the particles 40 which are immersed in the solvent layer 38 are thus melted or dissolved. Then, as shown in FIG. 2(*c*), the organic solvent is evaporated to remove the solvent layer 38, whereupon the particles 40 are adhered to the conductive layer 36 in the intended positions. The manner in which the particles 40 are adhered to the conductive layer 36 is shown in FIG. 3 (only one particle is illustrated). FIG. 3 clearly shows that the particle 40 is partly melted into an adhering region 41 which is bonded to the conductive layer 36.

Since the adhesion between the conductive layer 36 and the particles 40 can be visually checked easily at this time, it is possible to confirm beforehand the positions where apertures 14 are formed in an electroformed object 10 which will later be manufactured by an electroforming process.

After the conductive layer 36 and the particles 40 have been placed on the upper surface 22 of the model 20, the model 20 is immersed in the electrolytic solution 26 in the container 24 as shown in FIG. 2(*d*). the lead 34 connected to the negative terminal of the power supply 28 is connected to the conductive layer 36, and the electrodes 32*a* through 32*c* connected to the positive terminal of the power supply 28 through the respective leads 30*a* through 30*c* are positioned in the electrolytic solution 26 in a pattern complementary to the shape of the upper surface 22 of the model 20. Now, metal such as nickel or the like dissolved in the electrolytic solution 26 is separated out and deposited on the surface of the conductive layer 36 as a layer filling the gaps between the particles 40, thereby forming an electroformed shell 42. As shown in FIG. 2(*d*), the thickness of the electroformed shell 42 is selected to be thinner than the diameter of the particles 40, with the outer ends of the particles 40 being exposed from the surface of the electroformed shell 42 into the electrolytic solution 26.

Then, model 20 is removed from the container 24, and the electroformed shell 42 and the particles 40 are separated from the model 20, after which they are immersed in an organic solvent which is identical to the organic solvent which has been coated to form the solvent layer 38 on the conductive layer 36. The particles 40 are thus dissolved away from the electroformed shell 42, whereupon an electroformed object 10 having vent apertures 14 shown in FIG. 1 is produced.

The vent apertures 14 can be defined in the electroformed object 10 accurately and easily at desired locations.

More specifically, as shown in FIG. 2(*b*), the solvent layer 38 of toluene, for example, is coated on the conductive layer 36, and the particles 40 of polystyrene which can be dissolved by toluene are placed at positions where vent apertures 14 should be defined in the electroformed object 10. The particles 40 are therefore partly melted or dissolved by the solvent layer 38. By then evaporating the solvent layer 38, the particles 40 stick to the conductive layer 36 as shown in FIGS. 2(*c*)

and 3. Consequently, the positions and shape of vent apertures 14 to be defined in an electroformed object 10 can be confirmed in advance, with the results that a porous electroformed object 10 of excellent quality can be manufactured efficiently. Since the particles 40 can be adhered to the conductive layer 36 in mutually spaced-apart relationship, they are prevented from being unduly clustered together and making the produced electroformed object 10 low in mechanical strength.

The diameter of the openings 16 communicating with the apertures 14 can be selected by selecting the diameter of the particles 40 and the thickness of the solvent layer 38.

In the illustrated embodiment, the particles 40 of polystyrene had a diameter ranging from 0.5 mm to 0.6 mm, and the organic solvent of toluene was employed. With the solvent layer 38 of toluene being deposited on the conductive layer 36 up to a thickness ranging from 10 μm to 20 μm, the diameter of the adhereing region 41 (FIG. 3) of each particle 40 which sticks to the conductive layer 36, i.e., the diameter of each opening 16 shown in FIG. 1, ranged from 0.2 mm to 0.3 mm. When particles 40 of acrylic resin having a diameter ranging from 0.5 mm to 0.6 mm were used, and an organic solvent of methylene chloride was coated to form a solvent layer having a thickness ranging from 20 μm to 30 μm, it was confirmed that each opening 16 also had a diameter ranging from 0.2 mm to 0.3 mm.

Accordingly, the diameter of each of the openings 16 defined in the electroformed object 10 can effectively be varied dependent on the diameter of the particles 40 made of polystyrene or the like and the thickness of the solvent layer 38.

In this embodiment, it is not necessary to subsequently form apertures in the electroformed object 10 by drilling or laser machining. Therefore, the cost of equipment needed to carry out the manufacturing process is lowered, and the electroformed object 10 can efficiently be manufactured.

Figure 4:
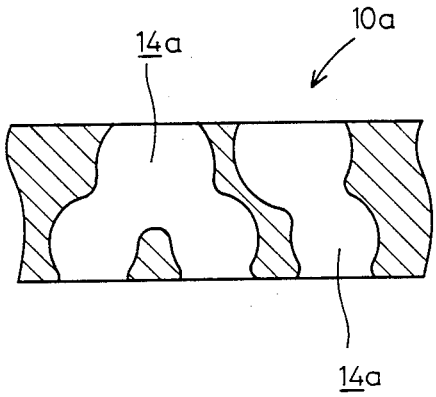
FIG. 4 is an enlarged fragmentary cross-sectional view of another electroformed object manufactured by the method of the present invention.

An electroformed object 10*a* shown in FIG. 4 which has apertures 14*a* more complex in shape than the apertures 14 and is thicker than the electroformed object 10 can easily be produced by repeating the processing steps described above.

Figure 5:
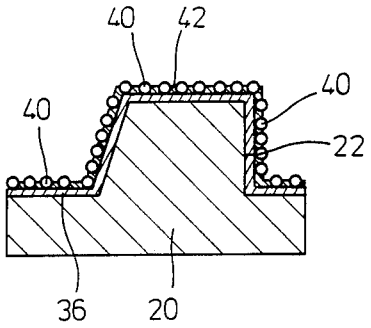
FIGS. 5(*a*) through 5(*d*) are vertical cross-sectional views illustrating a sequence of steps for manufacturing the electroformed object shown in FIG. 4.
Figure 5:
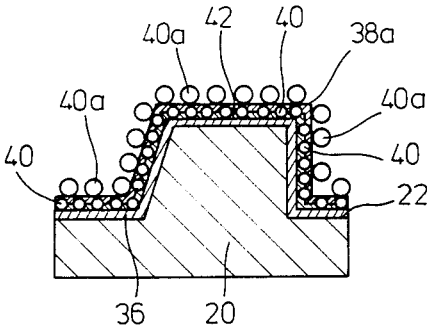
Figure 5C:
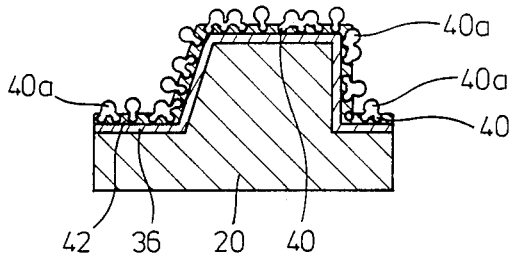
Figure 5D:
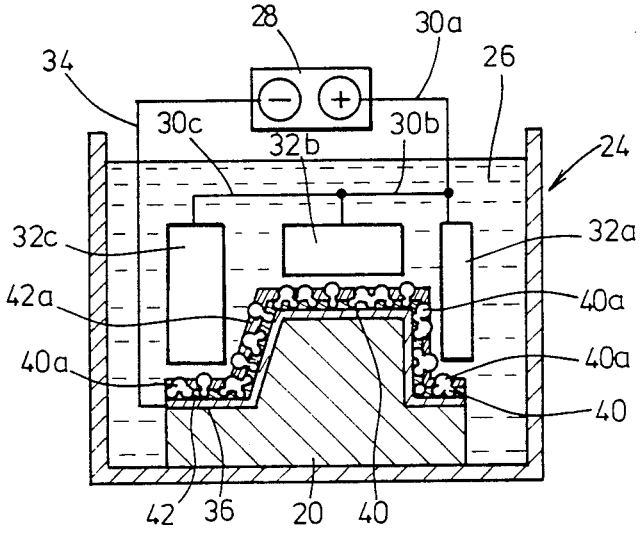

More specifically, after the electroformed shell 42 has been deposited on the conductive layer 36 as illustrated in FIG. 2(*d*), the model 20 is taken out of the container 24 as shown in FIG. 5(*a*). Then, a solvent layer 38*a* is coated on the outer surface of the electroformed shell 42 up to a prescribed thickness, and particles 40*a* larger in diameter than the particles 40 are placed on the solvent layer 38*a* as illustrated in FIG. 5(*b*), whereupon the portions of the particles 40*a* which are immersed in the solvent layer 38*a* are melted. Then, the solvent layer 38*a* is evaporated away to allow the particles 40*a* to stick to the exposed ends of the particles 40 embedded in the electroformed shell 42, as shown in FIG. 5(*c*).

The model 20 is then immersed in the container 24, and a metal layer is deposited on the model 20 to form an electroformed shell 42*a* having a desired thickness on the surface of the electoformed shell 42 integrally therewith. The model 20 is removed from the container 24, and the electroformed shells 42, 42*a* are separated from the model 20, after which they are immersed in a solvent to dissolve the particles 40, 40*a*. The electroformed object 10*a* shown in FIG. 4 which has apertures 14*a* of complex shape is produced in this manner.

A method of manufacturing a porous electroformed object according to another embodiment of the present invention will be described below. In this embodiment, the electroformed objects 10, 10*a* are manufactured using the model 20 shown in FIGS. 2 and 5. The diameter of the openings 16 defined in the surface of the electroformed object 10 can be adjusted to a desired value by selecting the type of the organic solvent making up the solvent layer 38, and the type and diameter of the particles 40.

More specifically, as shown in FIG. 3, the portion of each particle 40 which is immersed in the solvent layer 38 is melted into the adhering region 41 which sticks to the conductive layer 36. After a metal layer has been desposited on the model 20, the adhering regions 41 are dissolved away to eventually define the openings 16 in the electroformed object 10. Thus, it can be understood that if the shape of the adhering region 41 can be selected, then it is possible to adjust the diameter of the opening 16 defined in the electroformed object 10 to a desired value.

Figure 6:
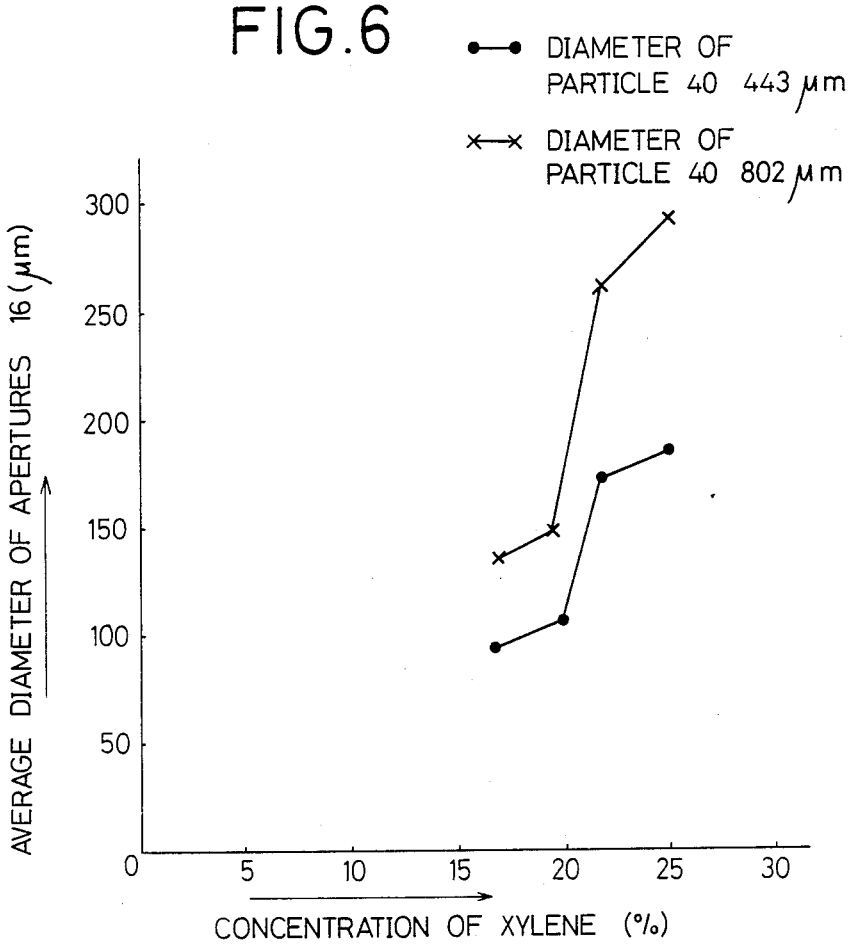
FIG. 6 is a graph showing the relationhip between the diameter of an aperture in an electroformed object and the concentration of an organic solvent in a method according to another embodiment of the present invention.

The applicant conducted an experiment in which a mixture of xylene and ethanol was used as an organic solvent, and particles 40 of polystyrene were employed, in order to detect how the diameter of openings 16 varies by varying the concentration of xylene with respect to ethanol and the diameter of the polystyrene particles 40. The results are shown in FIG. 6 and Tables 1 and 2 below.

Table 1

TABLE 1

| Diameter of the particles 40: 802 μm | | | | |
|---|---|---|---|---|
| Xylene concentration (%) | 17 | 20 | 22 | 25 |
| Average diameter of openings 16 (μm) | 133 | 152 | 257 | 242 |

Table 2

TABLE 2

| Diameter of the particles 40: 443 μm | | | | |
|---|---|---|---|---|
| Xylene concentration (%) | 17 | 20 | 22 | 25 |
| Average diameter of openings 16 (μm) | 97 | 106 | 169 | 183 |

Therefore, by using a mixture of 20% of xylene and 80% of ethanol as an organic solvent and polystyrene particles 40 having a diameter of 443 μm as shown in Table 2 above, openings 16 having a diameter of 106 μm are defined in the electroformed object 10.

As described above, therefore, the diameter of the openings 16 in the electroformed object 10 can be adjusted to a desired value by selecting the type and diameter of the particles 40 dependent on the type and concentration of the organic solvent used. It is thus possible to manufacture the electroformed object 10 with high accuracy, and hence produce a covering layer of excellent quality using the electroformed object 10 according to the vacuum forming process. While it is possible to employ particles 40 of polyvinyl chloride, it is preferable to use particles of polystyrene as describe above for economic reasons.

In this embodiment, besides selecting the type of the organic solvent and the type and diameter of the particles 40, the electroformed objects 10, 10*a* can be manufactured by the same process as that of the first embodiment.

The particles 40, 40*a* employed in the previous embodiments are spherical in shape, but particles of other shapes may be employed according to the present invention.

Figure 7A:
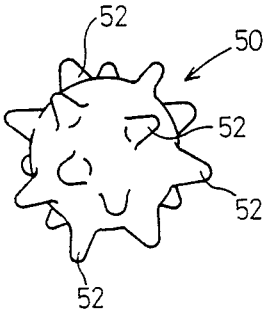
FIG. 7(*a*) is an enlarged perspective view of a particle of another shape.
Figure 7B:
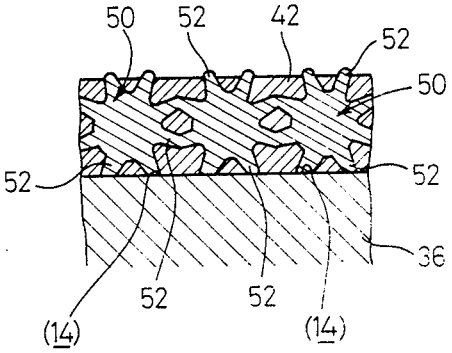

For example, FIG. 7(*a*) shows a particle 50 of a substantially spherical shape which has a plurality of radially outwardly projecting conical protuberances 52. After the particles 50 have been adhered to the conductive layer 36, a metal layer is deposited on the conductive layer 36 in the container 24 shown in FIG. 2(*d*) to produce an electroformed shell 42 containing the particles 50 on the surface of the conductive layer 36 (see FIG. 7 (*b*)).

Since some of the protuberances 52 of the particles 50 are adhered to the conductive layer 36, a plurality of vent apertures 14 can be formed by each of the particles 50. Consequently, a number of vent apertures 14 can be defined in the electroformed object 10 by a smaller number of particles 50. Therefore, the particles 50 can be placed on the conductive layer 36 more efficiently, i.e., within a shorter period of time.

With the protuberances 52, the overall size of the particles 50 may be greater than the size of the particle 40 or 40a. Thus, an electroformed shell 41 which is considerably thick can be manufactured in a single electroforming process. By adjusting the spacing or interval between adjacent ones of the protuberances 52, it is easily possible to control the spacing and distribution of vent apertures 14 defined in the electroformed object 10.

Figure 8A:
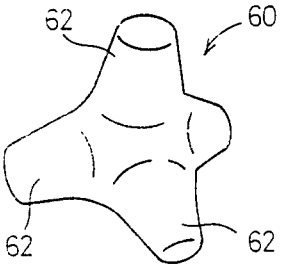
FIG. 8(*a*) is an enlarged perspective view of a particle of still another shape.
Figure 8B:
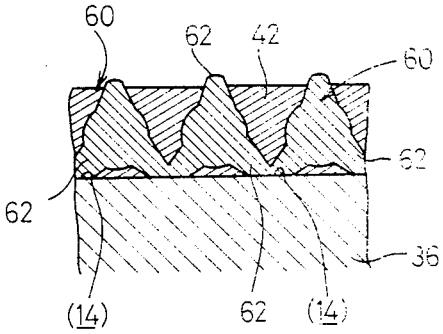

FIG. 8(*a*) shows a particle 60 having a plurality of conical bulges 62 projecting radially outwardly. An electroformed shell 42 containing such particles 60 is manufactured as shown in FIG. 8(*b*). The particles 60 offers substantially the same advantages as those of the particle 50.

With the present invention, as described above, the conductive layer is formed on the surface of the model, and after the particles are adhered to the conductive layer through the organic solvent, the electroformed shell is formed by the electroforming process, after which the particles are dissolved away from the electroformed shell to produce an electroformed object having a plurality of vent apertures. A desired number of vent apertures can easily and reliably be defined in the electroformed object at desired locations and the electroformed object can have a sufficient degree of mechanical strength by selecting the positions of the particles. By adhering the particles to the conductive layer with the organic solvent, the diameter of the openings at the covering surface of the electroformed object can be made sufficiently large, and the diameter of the openings can be selected as desired. The process of manufacturing the electroformed object is simplified, and the electroformed object can be manufactured efficiently.

Moreover, before the particles are adhered to the conductive layer on the model surface with the organic solvent, the type and/or diameter of the particles is selected dependent on the type and concentration of the organic solvent to control the manner in which the particles are to be adhered to the conductive layer. After the metal layer has been deposited, the particles are dissolved away to produce an electroformed object having a plurality of vent apertures. The diameter of the openings at the covering surface of the electroformed object can be adjusted to a desired value simply by selecting the type and size of the particles dependent on the organic solvent. Accordingly, a highly accurate electroformed object having desired vent apertures can be produced, and a covering layer of excellent quality can be manufactured by the electroformed object according to the vacuum forming process.

The electrically conductive layer may be a nickel plated layer or a copper plated layer, rather than a silver plated layer.

Although certian preferred embodiments have been shown and described, it should be understood that many changes and modifications may be made therein without departing from the scope of the appended claims.

What is claimed is:

1. A method of manufacturing a porous electroformed object, comprising the steps of:

forming an electrically conductive layer on a surface of a model;

forming an organic solvent layer of an organic solvent which is inactive with respect to said conductive layer on a surface of said conductive layer;

placing particles on said organic solvent layer to allow the particles to be partly melted by the organic solvent layer;

removing said organic solvent layer to allow the particles to be adhered to said conductive layer;

depositing a metal layer on said model in an electroforming process to form an electroformed shell thinner than the diameter of said particles;

separating said electroformed shell from said model; and dissolving said particles away from said electroformed shell with an organic solvent to produce an electroformed object having a number of vent apertures.

2. A method according to claim 1, wherein the diameter of said particles to be adhered to said conductive layer and the thickness of said organic solvent layer are selected to adjust the manner in which said particles are adhered to said conductive layer by said organic solvent.

3. A method according to claim 1 or 2, wherein said conductive layer comprises one of a silver plated layer, a nickel plate layer, and a copper plate layer.

4. A method according to claim 1 or 2, wherein each of said particles has a plurality of radially outward projections.

5. A method according to claim 1 or 2, wherein said organic solvent comprises a mixture solution containing ethanol and at least one material selected from the group consisting of methyl ethyl ketone, ethylene dichloride, toluene, ethylene tetrachloride, xylene, and methylene chloride.

6. A method according to claim 1 or 2, wherein said organic solvent comprises at least one material selected from the group consisting of methyl ethyl ketone, ethylene dichloride, toluene, ethylene tetrachloride, xylene, and methylene chloride.

7. A method according to claim 1 or 2, wherein each of said particles is made of a material selected from the group consisting of polystyrene, acrylic resin, and polyvinyl chloride.

8. A method according to claim 1, wherein after a first electroformed shell has been formed on the conductive layer on the surface of said model, second particles are adhered to first particles exposed out of said first electroformed shell by an organic solvent, then a metal layer is deposited on said model to form a second electroformed shell integrally on said first electroformed shell, said second electroformed shell being thinner than the diameter of said second particles, and said first and second electroformed shells are separated from said model, after which said first and second particles are dissolved away by an organic solvent to produce an electroformed object having a number of vent apertures.

9. A method of manufacturing a porous electroformed object, comprising the steps of:

forming an electrically conductive layer on a surface of a model;

forming an organic solvent layer of an organic solvent which is inactive with respect to said conductive layer on a surface of said conductive layer;

selecting the type and/or diameter of particles to be adhered to said conductive layer dependent on said organic solvent to adjust the manner in which the particles are to be adhered to said conductive layer;

placing said particles on said organic solvent layer to allow the particles to be partly melted by the organic solvent layer;

removing said organic solvent layer to allow the particles to be adhered to said conductive layer;

depositing a metal layer on said model in an electroforming process to form an electroformed shell thinner than the diameter of said particles;

separating said electroformed shell from said model; and dissolving said particles away from said electroformed shell with an organic solvent to produce an electroformed object having a number of vent apertures.

10. A method according to claim 9, wherein said conductive layer comprises one of a silver plated layer, a nickel plate layer, and a copper plated layer.

11. A method according to claim 9, wherein each of said particles has a plurality of radially outward projections.

12. A method according to claim 9, wherein the type of said particles to be adhered to said conductive layer is selected dependent on the type of said organic solvent.

13. A method according to claim 9, wherein the type of said particles to be adhered to said conductive layer is selected dependent on the concentration of said organic solvent.

14. A method according to claim 9, wherein the diameter of said particles to be adhered to said conductive layer is selected dependent on the type of said organic solvent.

15. A method according to claim 9, wherein the diameter of said particles to be adhered to said conductive layer is selected dependent on the concentration of said organic solvent.

16. A method according to any one of claims 12 through 15, wherein said organic solvent comprises a mixture solution of xylene and ethanol.

17. A method according to any one of claims 12 through 15, wherein each of said particles is made of a material selected from the group consisting of polystyrene and polyvinyl chloride.

18. A method according to claim 9, wherein after a first electroformed shell has been formed on the conductive layer on the surface of said model, second particles are adhered to first particles exposed out of said first electroformed shell by an organic solvent, then a metal layer is deposited on said model to form a second electroformed shell integrally on said first electroformed shell, said second electroformed shell being thinner than the diameter of said second particles, and said first and second electroformed shells are separated from said model, after which said first and second particles are dissolved away by an organic solvent to produced an electroformed object having a number of vent apertures.

19. A method of manufacturing a porous electroformed object, comprising the steps of:

forming an electrically conductive layer on a surface of a model;

forming an organic solvent layer of an organic solvent which is inactive with respect to said conductive layer on a surface of said conductive layer;

adjusting the manner in which selected particles are to be adhered to said conductive layer by employing the organic solvent which has been adjusted in its ability to melt the particles dependent on said selected particles;

placing said particles on said organic solvent layer to allow the particles to be partly melted by the organic solvent layer;

removing said organic solvent layer to allow the particles to be adhered to said conductive layer;

depositing a metal layer on said model in an electroforming process to form an electroformed shell thinner than the diameter of said particles;

separating said electroformed shell from said model; and dissolving said particles away from said electroformed shell with an organic solvent to produce an electroformed object having a number of vent apertures.

20. A method according to claim 19, wherein said solvent comprises a mixture solution containing ethanol.

* * * * *